United States Patent [19]

Royce, Jr.

[11] Patent Number: 4,601,287

[45] Date of Patent: Jul. 22, 1986

[54] HEATED SURVIVAL FACE MASK

[76] Inventor: George H. Royce, Jr., Box 280, 114 S. Main, Wilburton, Okla. 74578

[21] Appl. No.: 785,631

[22] Filed: Oct. 8, 1985

Related U.S. Application Data

[63] Continuation-in-part of Ser. No. 250,969, Apr. 1, 1981, abandoned, and a continuation-in-part of Ser. No. 502,428, Jun. 8, 1983, abandoned.

[51] Int. Cl.[4] ..... A62B 7/00

[52] U.S. Cl. ..... 128/204.17; 128/206.23; 128/206.24

[58] Field of Search ..... 128/201.13, 204.17, 128/203.26, 203.27, 203.29, 204.11

[56] References Cited

U.S. PATENT DOCUMENTS

| | | | |
|---|---|---|---|
| 2,241,356 | 5/1941 | Magee | 128/203.29 |
| 2,309,846 | 2/1943 | Holm | 128/203.29 |
| 2,641,253 | 6/1953 | Engelder | 128/203.29 |
| 3,115,134 | 12/1963 | Schmahl | 128/203.29 |
| 3,139,885 | 7/1964 | Hirtz et al. | 128/203.29 |
| 3,820,540 | 6/1974 | Hirtz et al. | 128/203.29 |

FOREIGN PATENT DOCUMENTS

| | | | |
|---|---|---|---|
| 914188 | 10/1946 | France | 128/204.17 |
| 1257220 | 2/1961 | France | 128/204.17 |

*Primary Examiner*—Henry J. Recla
*Assistant Examiner*—Karin M. Reichle
*Attorney, Agent, or Firm*—Henderson & Sturm

[57] ABSTRACT

This invention relates to a face mask fabricated from air impervious material, having a single forward protrusion forming a pivoted ambient air intake and exhaust orifice, which contains a heating element to elevate the temperature of the incoming ambient air, and which is designed to direct all of the exhausted air over the heating element to thereby increase its efficiency.

8 Claims, 9 Drawing Figures

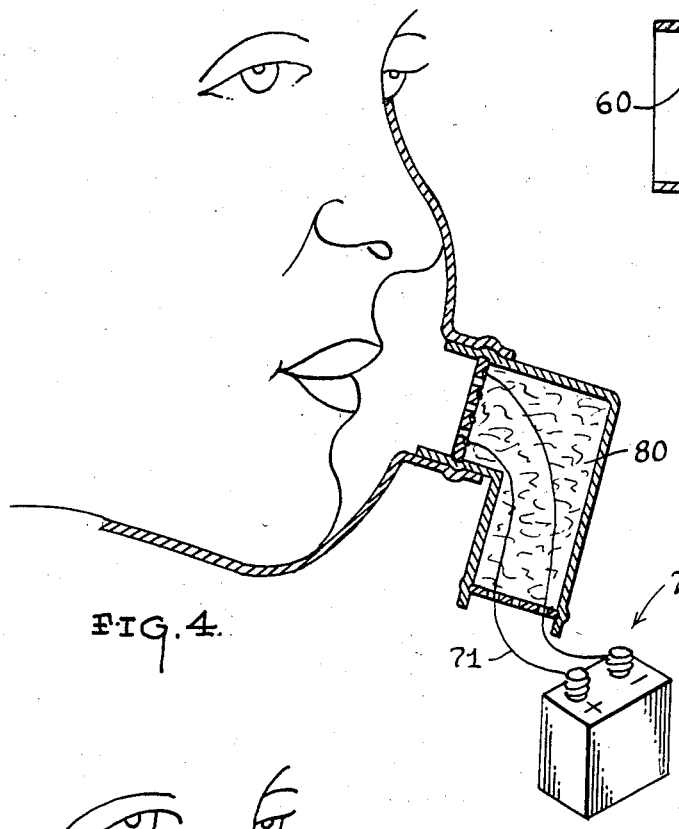
FIG. 4.
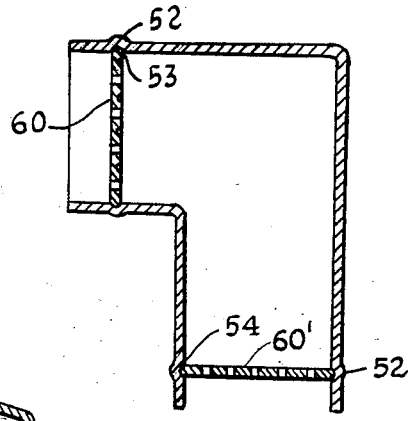
FIG. 5.
FIG. 7.
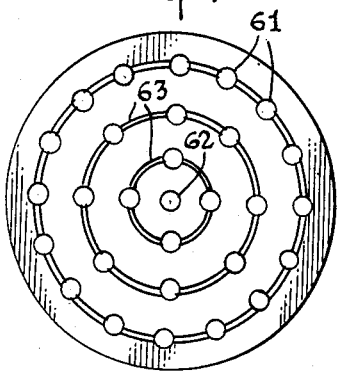
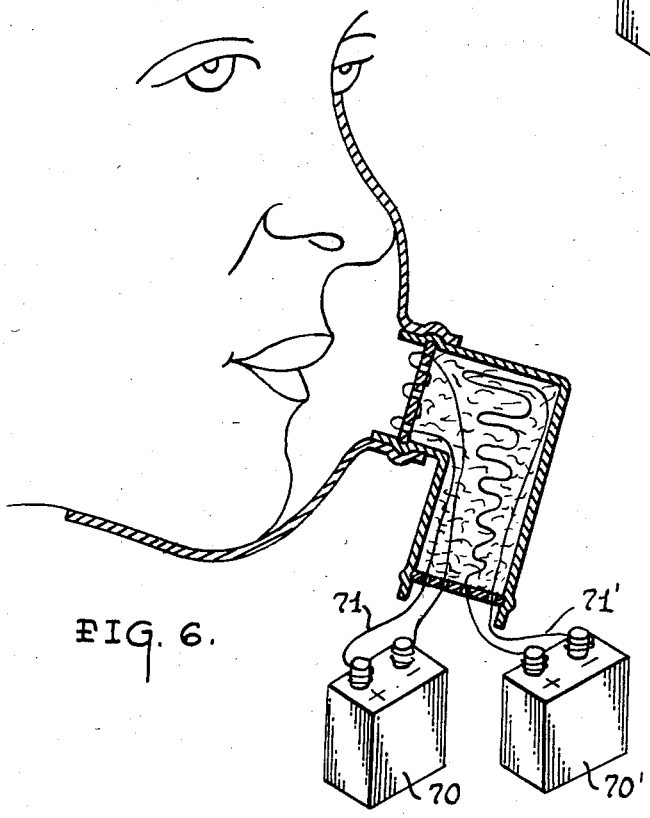
FIG. 6.
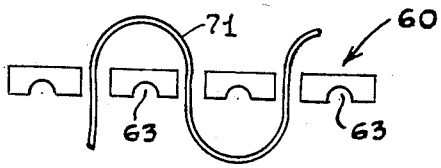
FIG. 8.
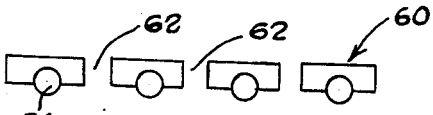
FIG. 9.

HEATED SURVIVAL FACE MASK

BACKGROUND OF THE INVENTION

This invention is a continuation-in-part application of my previously filed U.S. patent application Ser. No. 250,969 filed Apr. 1, 1981 entitled "SURVIVAL WITHSTANDER FACE MASK"; and U.S. patent application Ser. No. 502,428 filed June 8, 1983 entitled "IMPROVED SURVIVAL FACE MASK", both of which are now abandoned.

This invention relates to face masks in general, and is specifically directed to providing a means for protecting the respiratory tract of the wearer from cold air or wind. The preferred embodiment of the present invention is particularly well suited for use by patients suffering from cardiac conditions in general, and is especially beneficial in the case of coronary insufficiency.

It is well known that cold air often precipitates angina attacks in patients having heart problems, and by providing a device that warms the inhaled ambient air, the potential for these attacks is greatly reduced. The apparatus may also help some asthmatic patients, susceptible to attacks triggered by cold air, for the same reason. Another advantage of the invention is the added comfort it gives to normally healthy people, such as hunters, fishermen, joggers, as well motorcycle or snowmobile riders, or for that matter, anyone that exerts themselves outdoors in frigid climates.

Over the years there has been a significant amount of inventive activity directed to both breathing masks and other heated apparel. Examples include Fogel, et al., U.S. Pat. No. 2,626,343, which provided a facial mask with a removable heating element contained within a porous facial covering. Similarly, Hariv, U.S. Pat. No. 2,718,584, involved an electrically heated hood, with a moveable member for heating the nose and cheek area. Kerr, U.S. Pat. No. 3,858,028, also teaches the use of a self contained heating element within an article of clothing including a separable flap for covering the nose and mouth area. In addition, Terman, U.S. Pat. No. 3,249,108, utilizes a mask of porous material, such as fabric, provided with air vents on each side to allow the escape of exhaled air.

While the aforementioned patents deal with heated facial coverings, they are uniformly deficient in their failure to provide a face mask which passes all of the inhaled air over the heating element. The disadvantages of the prior art include the use of air pervious material, which allows not only air to enter the respiratory tract without passing through the heating assembly, but makes no provisions for the heated exhaled air to aid in maintaining the temperature of the heating element. Such provisions would increase the user's comfort, and also extend the effective life expectancy of whatever power source is being used, to power the heating element.

The prior art devices also fail to take into consideration, that a significant portion of the population wears glasses or goggles, when they are engaged in outdoor activities. The reasons for this are to correct vision, or as a protective measure, to shield the user's eyes from glare or wind. One of the main drawbacks to the use of eyewear in cold weather is the condensation of exhaled vapor on the lenses which results in the fogging of the user's glasses or goggles, which is a constant annoyance, that is most noticeable when the user remains stationery for prolonged periods of time, in relatively still wind conditions.

Hunters are particularly suspectible to this condition, since most cold weather hunting takes place in stands or blinds, where the hunter's objective is to remain motionless, so that their presence is not detected by animals or waterfowl. Given the fact that warm air rises, and most hunters face in the general direction of what prevailing wind there is, most bespectacle hunters are beset with the problem of their lenses fogging, invariably at the most impropitious times. Unfortunately, none of the prior art devices to date have provided a solution to this problem.

SUMMARY OF THE INVENTION

With the foregoing in mind, it is a principal object of the present invention to provide a mask, formed of air impervious material such as soft plastic or neoprene, designed to cover the wearer's nose, mouth and chin areas, and to conform tightly thereto. Said air impervious mask being adapted to contain a heating assembly and a combined intake and exhaust orifice is pivotally disposed at the distal end of the protrusion, and permits the incoming cold air to be heated by the heating element. Similarly, the combined intake and exhaust orifice will force the exhaled warm air to again pass through the heating assembly, therefore aiding in maintaining the desired temperature level of the heating assembly.

A further object of the invention is to provide a separable power source for the heating assembly of the mask, which will accommodate various power sources to increase or decrease the amount of heat delivered by the heating element.

Another object of the invention is to provide a mask formed of air impervious material, designed to fit tightly over the lower portion of the user's face, covering the nose, mouth, and chin areas, with an elastic headband for securing the mask in place against the face of the wearer.

Still another object of the present invention is the provision of a heated face mask having a pivotable exhaust member, to allow the heated exhaled air to be directed away from the direction of the prevailing wind.

Yet another object of the present invention is the provision of a heated face mask having a new and unique manner of disposing the heating element relative to at least one support member.

As yet further object of the instant invention is the provision of a face mask which will overcome all of the deficiencies of the prior art devices while employing the same basic configuration employed therein.

These and other objects, advantages and novel features of the invention will be fully understood when considered in light of the following detailed description of the invention, and viewed in conjunction with the accompanying drawings.

BRIEF DESCRIPTION OF THE DRAWINGS

These and other objects, advantages and novel features of the invention will become apparent from the detailed description of the preferred embodiment which follows; particularly when considered in conjunction with the accompanying drawings wherein:

FIG. 4, is a cross-sectional view of another form of the preferred embodiment.

FIG. 5, is a cross-sectional detail view of the disk elements mounted in the breathing passageway.

FIG. 6, is a cross-sectional view of still another form of the preferred embodiment.

FIG. 7, is a detailed view of one of the disk elements not equipped with the heating element.

FIG. 8, is a detail view of the threaded engagement of a heating element with a disk element; and FIG. 9 is a detail view of the frictional engagement of a heating element with a disk element.

DETAILED DESCRIPTION OF THE PREFERRED EMBODIMENT

Figure 1:
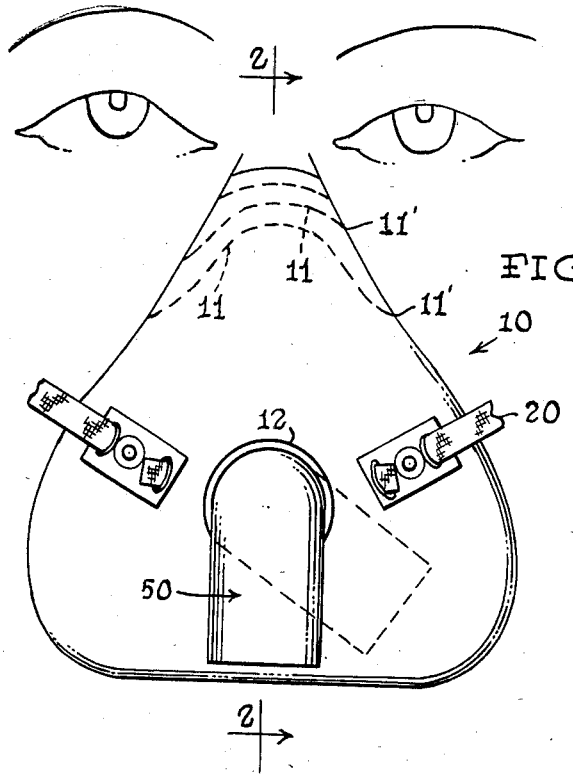
FIG. 1, is a frontal perspective view of the heated face mask, as it would appear on a user.

As can be seen by reference to FIG. 1, the face mask of the instant invention is designated generally as 1, and comprises a mask portion 10, which is dimensioned to cover the user's nose, mouth and chin areas, and to extend over a portion of the cheek area. This mask 10 is also configured to closely conform to the contour of the user's covered facial area, except in the area immediately adjacent the breathing orifices, i.e., nose and mouth, and to engage the user's face in a snug fitting relationship, when the mask portion 10 is secured to the user's head by releasable securing means 20.

The releasable securing means 20, may comprise any type of fastening means, such as strap and buckle or snap arrangement, and elastic band, tie straps, or strips of material having a VELCRO type closure disposed on their respective ends, etc. The primary function of the releasable securing means 20, is to provide the face mask 10, with a means to place the major portion of the mask in intimate contact with the user's face.

In as much as this improved face mask is designed to overcome the prior art deficiencies, normally encountered with face masks of this type; and to particularly take into consideration the problems that are associated with the wearing of glasses or goggles in conjunction therewith, a plurality of perforations 11 are disposed in several rows 11', that extend in contoured lines across that portion of the mask that covers the bridge of the user's nose.

The mask portion 10 is fabricated from air impervious material such as rubber or plastic, and the perforations 11 allow selected portions of the mask to be removed at the discretion of the user, to provide a customized fit to accommodate a pair of eyeglasses or goggles.

It should be appreciated, that outside of the very small perforations 11, adjacent the user's nose, the only other opening in the imperforate mask 10 is an enlarged central aperture 12, formed by a short tubular extension 13, that forms part of the breathing passageway 50 of the device.

As mentioned supra, the mask 10 particularly around the peripheral edges, is configured to have a snug fit with the user's face, and the only portion of the mask that is not intended to be in direct contact with the user's face, is the central area adjacent the user's nose and mouth, and the central aperture 12. The final structural feature of the mask portion, per se, is an annular recess 74 disposed on the interior surface of the short tubular extension 13.

The mask breathing tube 50 is in the form of an elongated, inverted, generally L-shaped tubular member 51, fabricated from either metal or rigid plastic. The tubular member 51, is provided with external rib elements 52, disposed proximate one end, and annular recesses 53 and 54, disposed on its interior, adjacent either end. In addition, the tubular member 51 and the upper rib element 52, are dimensioned to be slidingly engaged by the tubular mask extension 13 and its annular recess 74, and be rotatable with respect thereto.

As illustrated in FIG. 5, the annular recesses 53 and 54, in the ends of the breathing tube are further dimensioned to receive apertured breathing disks 60. As shown in FIG. 7, each of the breathing disks 60 are provided with a plurality of apertures 61, arranged in concentric circles surrounding a single similarly dimensioned central aperture 62. Each of the apertures in a given concentric ring, are further connected to the other apertures in that ring, via a plurality of shallow grooves 63 in the disk material.

The breathing disks 60, in the preferred embodiment are formed from plastic, so that they can engage the annular recesses in the breathing tube, in a snap fit relationship (FIG. 5). The apertures 61 and 62 are further dimensioned, so that their total surface area will not significantly impede the inhalation or exhalation of air through the breathing tube 60. Furthermore, this dimensioning will not create a backpressure of sufficient force to disengage the periphery of the mask from the users face upon exhalation.

This latter point is of particular significance, since one of the primary purposes of the design of this mask is to insure, that respiration of the ambient environment will only take place through the breathing passage, defined by the breathing tube 50, and the ambient atmosphere will not enter the mask interior, via the mask periphery.

As noted supra, each of the disks 60 are provided with a plurality of shallow recesses 63, that join the concentric rings of apertures 61 together. These shallow recesses are further dimensioned to frictionally engage a heating wire element 71, that is operatively engaged to an external power source 72, to form the heating member 70, for the heated mask 10.

Figure 3:
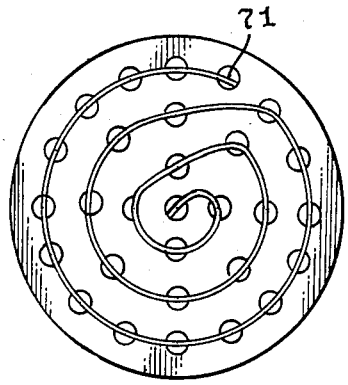
FIG. 3, is a detail view of one of the disk elements bearing the heating element.

As can be seen by reference to FIG. 3, in one embodiment the wire element 71 is threaded through one of the apertures 61 and arranged in a generally spiral pattern on the disk surface. The frictional engagement of the wire 71 in the recesses 63, not only insures that the wire will remain attached to the disk, but also that each of the apertures 61 will have at least a portion of the heating wire element 71 disposed across its opening.

In the embodiment depicted in FIG. 8, the wire heating element is threaded through adjacent apertures in the disk, and as mentioned supra, this arrangement also insures that each of the apertures 61 will have a portion of the wire heating element projecting therethrough.

In the embodiment depicted in FIG. 9, the wire heating element 71 is frictionally engaged by the side walls of the shallow recesses 63 in a breathing disk 60. While this drawing shows the recesses 63 being off-set from the apertures 61, this is for illustration purposes only; and, it is to be understood that the heating wire element 71 is intended to extend across at least a substantial portion of the plurality of apertures 61 in the breathing disk 60, similar to the arrangement depicted in FIG. 3.

Figure 2:
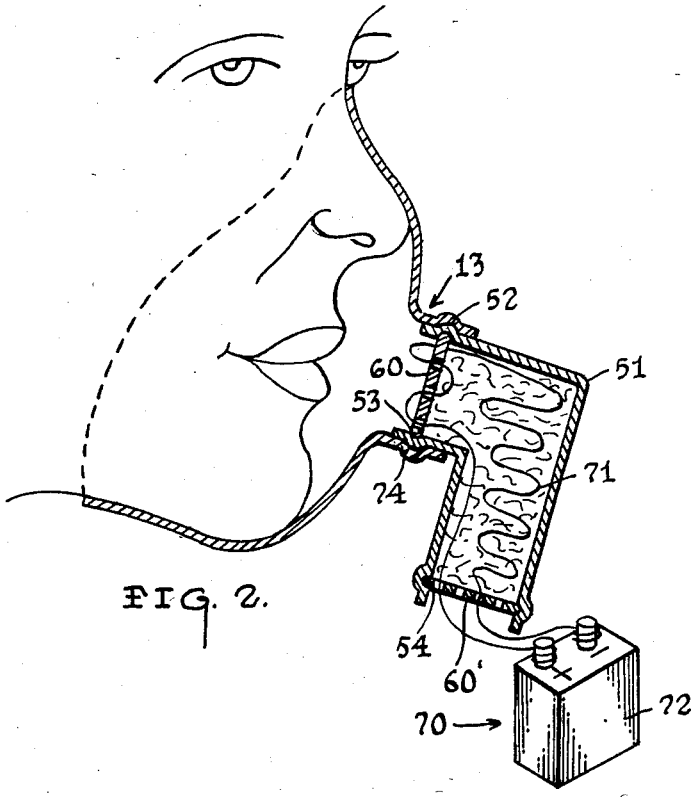
FIG. 2, is a cross-sectional view of one form of the preferred embodiment.

It should also be appreciated at this juncture that the heating wire element 71 can either be: threadedly engaged through both breathing disks 60, 60' as shown in FIGS. 2 and 8; or threadedly engaged by the outboard breathing disk 60' (FIG. 6) and then frictionally engaged by the shallow recesses in the inboard breathing disk 60 (FIG. 4); or threadedly engaged by the outboard breathing disk 60', and then both frictionally and threadedly engaged by the inboard breathing disk 60, as shown in FIG. 6.

All of these arrangements insure that air will not be able to enter through most if not all of the apertures 61, without being first subjected to the elevating temperature effects, induced by the flow of air around the wire heating element 71. Heat transfer takes place between the wire heating element 71, and the ambient inhaled air, in accordance with well recognized and accepted principles, to elevate the temperature of the incoming ambient air. Heating the ambient air prior to its contact with the nasal membranes, larynx and lungs, thereby conserves the body core temperature; since up to 75% of all body heat may be lost through respiration under given circumstances.

In one form of the preferred embodiment illustrated in FIG. 4, the wire heating element 71 is frictionally and threadedly attached to the inboard breathing disk 60, and the remainder of the space within the breathing tube 50, defined by the breathing disks 60 and 60', is partially filled with a non-combustible heating conducting filament 80, which is disposed in direct heat transfer contact with the wire heating element 71. The heat conducting filament 80, will not only greatly increase the surface area subject to the heat generated by the wire heating element 71, but it would further increase the overall efficiency of the mask, by absorbing heat energy from the exhaled air, which in turn would be transferred to the inhaled air.

In another form of the preferred embodiment illustrated in FIG. 6, the mask 10 is provided with two separate heating members 70 and 70'. One of the wire heating elements 71 is both frictionally and threadedly engaged with the inboard breathing disk 60, and the other wire heating element 71', is loosely disposed in the space inside the breathing tube 50, defined by the breathing disks 60 and 60'; wherein, both of the heating wire elements 71, 71' are threaded through the apertures (61) in the outboard breathing disk (60'). This particular embodiment is intended for use in extremely cold environments, wherein respiration of the untreated ambient air would be deleterious to an individual's health.

The power source 72 of the preferred embodiment is a dry cell battery, which can easily be carried on the users person, and whose voltage (6v or 12v) will vary depending on the heating requirements of the individual, and the climate in which it is employed. The heating member 70 can also be connected through an adapter (not shown) to a vehicle power source so that it may be utilized by boaters, snowmobiles, tractor operators, etc.

The wire heating element 71 in the preferred embodiment comprises a 15 gauge nichrome resistance wire, which is of a sufficient length to allow the breathing tube to be rotated 90° from the vertical. As mentioned earlier in the specification, the relative rotation between the breathing tube and the mask is necessary to allow the exhaust vapors exiting from the breathing tube, to be diverted towards the downstream direction of the air currents. This will allow the user to selectively position the breathing tube, so as to minimize or eliminate the fogging problems normally encountered when glasses or goggles are worn in conjunction with the mask 10.

It should further be appreciated that the specific embodiments disclosed herein can be used in all weather conditions, and furthermore, that the general concept can be incorporated into diver's mouthpieces, or used in conjunction with a resuscitator.

Having thereby disclosed the subject matter of this invention, it should be obvious that many modifications, substitutions and variations of the invention are possible in light of the above teachings. It is therefore to be understood, that the invention may be practiced other than as specifically described, and should be limited only to the breadth and scope of the appended claims.

What I claim is:

1. An improved heated face mask for use in outdoor activities in cold weather comprising:

a mask portion fabricated from air impervious material and adapted to cover a user's nose, mouth and cheek areas in a snug fitting relationship, wherein the mask portion is provided with an enlarged central aperture, formed by a short tubular extension formed in the mask portion;

an elongated generally L-shaped breathing tube, having one end rotably received in the said short tubular extension formed in the mask portion, and having apertured inboard and outboard breathing disks disposed adjacent the inboard and outboard ends of the breathing tube, wherein said apertured breathing disks are further provided with a plurality of apertures, and with shallow recesses in at least one of their faces;

a heating member comprising an external power source, and a heating wire element, wherein the heating wire element occupies the space in the breathing tube defined by the said breathing disks, and is dimensioned to be threadedly engaged through said apertures in said breathing disks, and frictionally engaged by the shallow recesses on the faces of the breathing disks; and, securing means attached to said mask portion and adapted to maintain the periphery of the mask portion in intimate contact with the user's face, so that all respiration will transpire through said breathing tube, and the inhaled ambient atmosphere will be heated as it passes around the heating element, wherein the heating wire element is threadedly passed through said apertures, in at least said outboard breathing disk.

2. An improved heated face mask as in claim 1; wherein, the said short tubular extension of the face mask portion is provided with an annular recess on its interior surface, proximate the free end of the tubular extension, and the breathing tube is provided with an external rib element proximate the inboard end thereof that is dimensioned to be rotatably received by the internal annular recess in the said short tubular extension.

3. An improved heated face mask as in claim 1; further comprising:

an additional heating member comprising an external power source and a heating wire element; wherein, the heating wire element of the additional heating member is threadedly popped through the apertures in said outboard breathing disk and loosely coiled in the space defined by said inboard and outboard breathing disks.

4. An improved heated face mask as in claim 1; wherein, said heating wire element is threadedly passed through said apertures in both said inboard and outboard breathing disks.

5. An improved heated face mask as in claim 4; wherein, said heating wire element is also threadedly passed through said shallow recesses on at least one of said breathing disks which frictionally engage portions of the heating wire element.

6. An improved heated face mask as in claim 1; wherein, said heating wire element is also threadedly passed through said shallow recesses on at least one of said breathing disks which frictionally engage portions of the heating wire element.

7. An improved heated face mask as in claim 1; wherein, said recesses are disposed in a concentric circle configuration.

8. An improved heated face mask as in claim 1; wherein, said recesses extend between said apertures, and said heating wire element is threadedly passed through selected recesses on at least one breathing disk which frictionally engage portions of said heating wire element to dispose said heating wire element across a substantial portion of said plurality of apertures in said at least one breathing disk.

* * * * *